US012759599B2

(12) United States Patent
Cho

(10) Patent No.: US 12,759,599 B2
(45) Date of Patent: Oct. 13, 2026

(54) TRANSPORT VEHICLE AND TRANSPORT APPARATUS

(71) Applicant: SEMES CO., LTD., Chungcheongnam-do (KR)

(72) Inventor: Chungil Cho, Seoul-si (KR)

(73) Assignee: SEMES CO., LTD., Chungcheongnam-Do (KR)

( * ) Notice: Subject to any disclaimer, the term of this patent is extended or adjusted under 35 U.S.C. 154(b) by 638 days.

(21) Appl. No.: 18/322,715

(22) Filed: May 24, 2023

(65) Prior Publication Data

US 2023/0406372 A1 Dec. 21, 2023

(30) Foreign Application Priority Data

Jun. 17, 2022 (KR) ..... 10-2022-0074198

(51) Int. Cl.

| | |
|---|---|
| ***B61G 5/02*** | (2006.01) |
| ***B61B 3/00*** | (2006.01) |
| ***E01B 19/00*** | (2006.01) |

(52) U.S. Cl.

CPC ..... *B61G 5/02* (2013.01); *B61B 3/00* (2013.01); *E01B 19/003* (2013.01)

(58) Field of Classification Search

CPC .... B61B 3/00; B61B 3/02; B61G 5/02; E01B 19/003

See application file for complete search history.

(56) References Cited

U.S. PATENT DOCUMENTS

| | | | | |
|---|---|---|---|---|
| 7,581,502 | B2 | 9/2009 | Nakao | |
| 7,963,229 | B2 | 6/2011 | Timan | |
| 2022/0165598 | A1* | 5/2022 | Cho | B60L 7/28 |

FOREIGN PATENT DOCUMENTS

| | | | |
|---|---|---|---|
| CN | 111891143 | A | 11/2020 |
| CN | 114524274 | A | 5/2022 |
| JP | H07-246930 | A | 9/1995 |
| JP | 4264834 | B2 | 5/2009 |
| KR | 10-2011-0030500 | A | 3/2011 |
| KR | 10-2021-0010040 | A | 1/2021 |
| KR | 10-2021-0055292 | A | 5/2021 |

(Continued)

OTHER PUBLICATIONS

Korean Office Action issued in corresponding KR Patent Application No. 10-2022-0074198 on Dec. 5, 2023, with English translation.

(Continued)

*Primary Examiner* — Robert J McCarry, Jr.
(74) *Attorney, Agent, or Firm* — Carter, DeLuca & Farrell LLP

(57) ABSTRACT

A transport vehicle is provided. The transport vehicle includes a front driving device including front wheels, a front drive shaft transmitting a driving force to the front wheels, and a front vibration reduction device, and a rear driving device including rear wheels, a rear drive shaft transmitting a driving force to the rear wheels, and a rear vibration reduction device, wherein, when the transport vehicle moves in a straight section, the front vibration reduction device and the rear vibration reduction device are coupled to each other, and when the transport vehicle moves in a corner section, the front vibration reduction device and the rear vibration reduction device are separated from each other.

20 Claims, 10 Drawing Sheets

(56) References Cited

FOREIGN PATENT DOCUMENTS

| | | | |
|---|---|---|---|
| KR | 10-2021-0144442 | A | 11/2021 |
| KR | 10-2022-0057014 | A | 5/2022 |
| KR | 10-2022-0070980 | A | 5/2022 |
| WO | 2005/056361 | A1 | 6/2005 |

OTHER PUBLICATIONS

Korean Notice of Allowance issued in corresponding KR Patent Application No. 10-2022-0074198, dated Dec. 26, 2024, with English translation.
Chinese Office Action issued by the China National Intellectual Property Administration on Sep. 8, 2026 in corresponding CN Patent Application No. 202310646395.1, with English translation.

* cited by examiner

TRANSPORT VEHICLE AND TRANSPORT APPARATUS

CROSS-REFERENCE TO RELATED APPLICATION

This application is based on and claims priority under 35 U.S.C. § 119 to Korean Patent Application No. 10-2022-0074198, filed on Jun. 17, 2022, in the Korean Intellectual Property Office, the disclosure of which is incorporated by reference herein in its entirety.

BACKGROUND

1. Field

The disclosure relates to a transport vehicle and a transport apparatus, and more particularly, to a transport vehicle and a transport apparatus for transporting materials for manufacturing a semiconductor device and a display device.

2. Description of the Related Art

In the processes of manufacturing a semiconductor device and a display device, materials such as a semiconductor wafer, a semiconductor strip, a glass substrate, and a display panel may be transported using an unmanned transport system such as an overhead hoist transport (OHT) apparatus, a rail guided vehicle (RGV) apparatus, or an automatic guided vehicle (AGV).

The OHT apparatus may include a transport vehicle configured to be movable along a driving rail installed on the ceiling of a clean room. A plurality of transport vehicles arranged on the driving rail move along the driving rail and transport materials from some positions to other positions on the driving rail.

SUMMARY

Provided are a transport vehicle and a transport apparatus with improved driving stability.

Additional aspects will be set forth in part in the description which follows and, in part, will be apparent from the description, or may be learned by practice of the presented embodiments of the disclosure.

According to an aspect of the disclosure, a transport apparatus includes a hoist device configured to grip a material, and a transport vehicle coupled to the hoist device and configured to transport the hoist device.

The transport vehicle includes a front driving device including front wheels, a front drive shaft transmitting a driving force to the front wheels, and a front vibration reduction device, and a rear driving device including rear wheels, a rear drive shaft transmitting a driving force to the rear wheels, and a rear vibration reduction device.

When the transport vehicle moves in a straight section, the front vibration reduction device and the rear vibration reduction device are coupled to each other, and when the transport vehicle moves in a corner section, the front vibration reduction device and the rear vibration reduction device are separated from each other.

According to another aspect of the disclosure, a transport vehicle is provided. The transport vehicle includes a front driving device including front wheels, a front drive shaft transmitting a driving force to the front wheels, a front vibration reduction device, and a rear driving device including rear wheels, a rear drive shaft transmitting a driving force to the rear wheels, and a rear vibration reduction device, and a controller configured to control the front vibration reduction device and the rear vibration reduction device, wherein the controller is configured to control the front vibration reduction device and the rear vibration reduction device such that the front vibration reduction device and the rear vibration reduction device are electromagnetically coupled to each other when the transport vehicle moves in a straight section.

According to another aspect of the disclosure, a transport apparatus includes a hoist device configured to grip a material, and a transport vehicle coupled to the hoist device and configured to transport the hoist device.

The transport vehicle includes a front driving device including a front body connected to the hoist device, a front rotation shaft configured to rotate with respect to the front body, a front drive shaft connected to the front rotation shaft, and front wheels connected to the front drive shaft, a rear driving device including a rear body connected to the hoist device, a rear rotation shaft configured to rotate with respect to the rear body, a rear drive shaft connected to the rear rotation shaft, and rear wheels connected to the rear drive shaft, and a vibration reduction device connected to each of the front driving device and the rear driving device.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
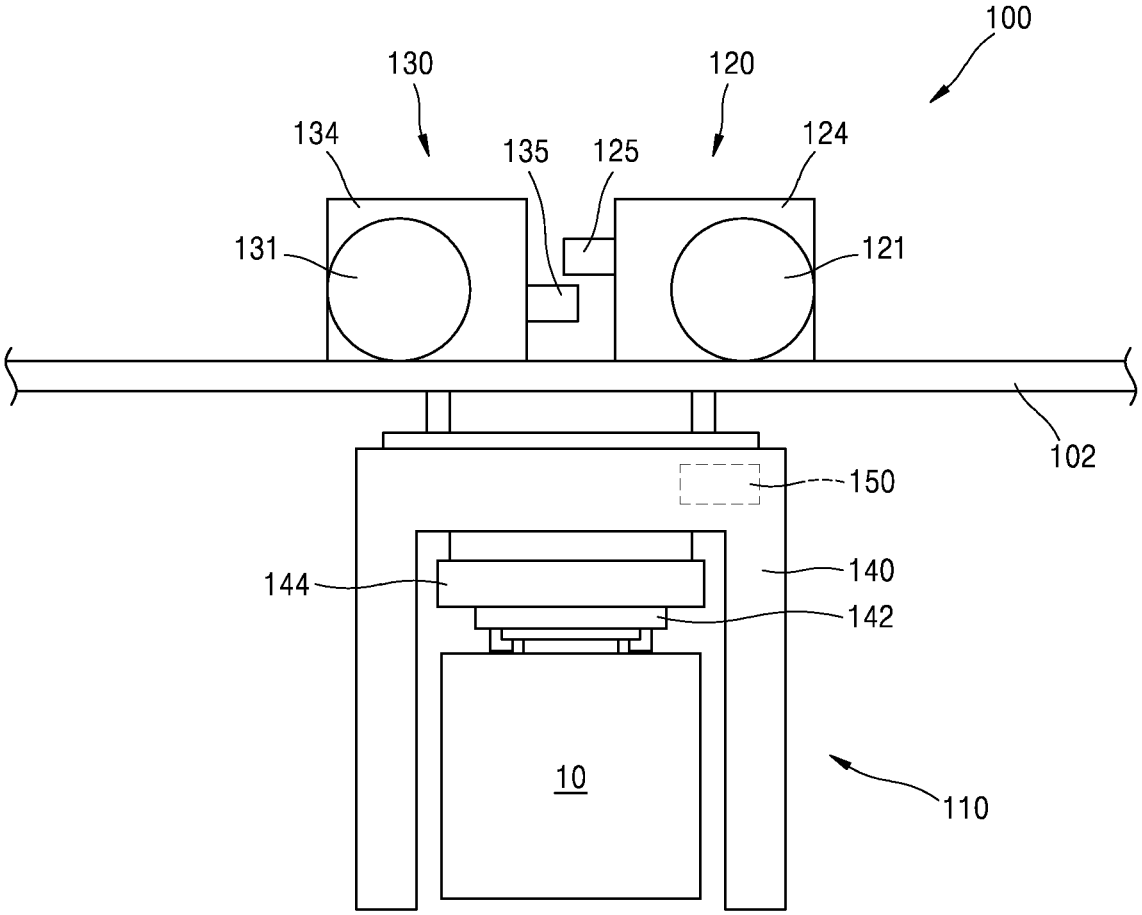
FIG. 1 is a schematic side view for describing a transport apparatus according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Hereinafter, embodiments will be described in detail with reference to the accompanying drawings. Herein, like reference numerals will denote like elements, and redundant descriptions thereof will be omitted for conciseness.

FIG. 1 is a schematic side view for describing a transport apparatus 100 according to an embodiment.

Referring to FIG. 1, the transport apparatus 100 may be configured to transport a material 10 in the process of manufacturing a semiconductor device or a display device.

An example of the material 10 may include a front opening unified pod (FOUP) in which a plurality of wafers are accommodated.

The transport apparatus 100 may include a driving rail 102 installed on the ceiling of a facility such as a clean room in which a process of manufacturing a semiconductor device or a display device is performed. The driving rail 102 may extend along a set transport path inside the clean room. The driving rail 102 may be fixed to the ceiling of the clean room by a race way structure.

The transport apparatus 100 may include a transport vehicle 110 configured to move along the driving rail 102 and a hoist device 140 elevating and fixing the material 10.

The transport vehicle 110 may include a front driving device 120 and a rear driving device 130. The front driving device 120 and the rear driving device 130 may be arranged on the driving rail 102.

The front driving device 120 may include front wheels 121, a front drive shaft 122, a front rotation shaft 123, a front body 124, and a front vibration reduction device 125.

The front body 124 may be connected to the hoist device 140.

The front rotation shaft 123 may connect the front body 124 with the front drive shaft 122. The front drive shaft 122 may be rotated with respect to the front body 124 by the front rotation shaft 123.

The front drive shaft 122 may be connected to the front rotation shaft 123 and the front wheels 121. The front drive shaft 122 may be configured to transmit a driving force to the front wheels 121. The front drive shaft 122 may rotate with respect to the front body 124. As the front drive shaft 122 rotates, the direction in which the front wheels 121 are directed may be changed. Accordingly, the front driving device 120 may move along a corner section and a straight section of the driving rail 102.

The front wheels 121 may be arranged on the driving rails 102. The front wheels 121 may move on the driving rails 102 based on the driving force transmitted through the front drive shaft 122.

The front vibration reduction device 125 may be arranged on a horizontal center line of the front body 124.

The front driving device 120 may further include a front drive motor configured to generate a driving force transmitted through the front drive shaft 122.

The rear driving device 130 may include rear wheels 131, a rear drive shaft 132, a rear rotation shaft 133, a rear body 134, and a rear vibration reduction device 135.

The rear body 134 may be connected to the hoist device 140.

The rear rotation shaft 133 may connect the rear body 134 with the rear drive shaft 132. The rear drive shaft 132 may be rotated with respect to the rear body 134 by the rear rotation shaft 133.

The rear drive shaft 132 may be connected to the rear rotation shaft 133 and the rear wheels 131. The rear drive shaft 132 may be configured to transmit a driving force to the rear wheels 131. The rear drive shaft 132 may rotate with respect to the rear body 134. As the rear drive shaft 132 rotates, the direction in which the rear wheels 131 are directed may be changed. Accordingly, the rear driving device 130 may move along the corner section and the straight section of the driving rail 102.

The rear wheels 131 may be arranged on the driving rails 102. The rear wheels 131 may move on the driving rails 102 based on the driving force transmitted through the rear drive shaft 132.

The rear vibration reduction device 135 may be arranged on a horizontal center line of the rear body 134.

The rear driving device 130 may further include a rear drive motor configured to generate a driving force transmitted through the rear drive shaft 132.

The front vibration reduction device 125 and the rear vibration reduction device 135 may alleviate a vibration generated during the movement of the front driving device 120 and the rear driving device 130. Accordingly, the driving stability and damping performance of the front driving device 120 and the rear driving device 130 may be improved.

The front vibration reduction device 125 and the rear vibration reduction device 135 may be vertically arranged with respect to each other. In other words, the front vibration reduction device 125 and the rear vibration reduction device 135 may vertically overlap each other. The front vibration reduction device 125 and the rear vibration reduction device 135 may be vertically spaced apart from each other. The vertical direction may be a direction perpendicular to the bottom surface of a space (e.g., a semiconductor device manufacturing fab) in which the front vibration reduction device 125 and the rear vibration reduction device 135 are installed.

In the present embodiment, the front vibration reduction device 125 is illustrated as being arranged over the rear vibration reduction device 135; however, in another embodiment, the rear vibration reduction device may be arranged over the front vibration reduction device.

The transport vehicle 110 may further include a controller for controlling the front vibration reduction device 125 and the rear vibration reduction device 135.

The hoist device 140 may be connected to the front driving device 120 and the rear driving device 130.

The hoist device 140 may include a handling device 142 including a gripper for gripping the material 10 and an elevation device 144 for elevating the handling device 142 by using elevation belts.

Figure 2A:
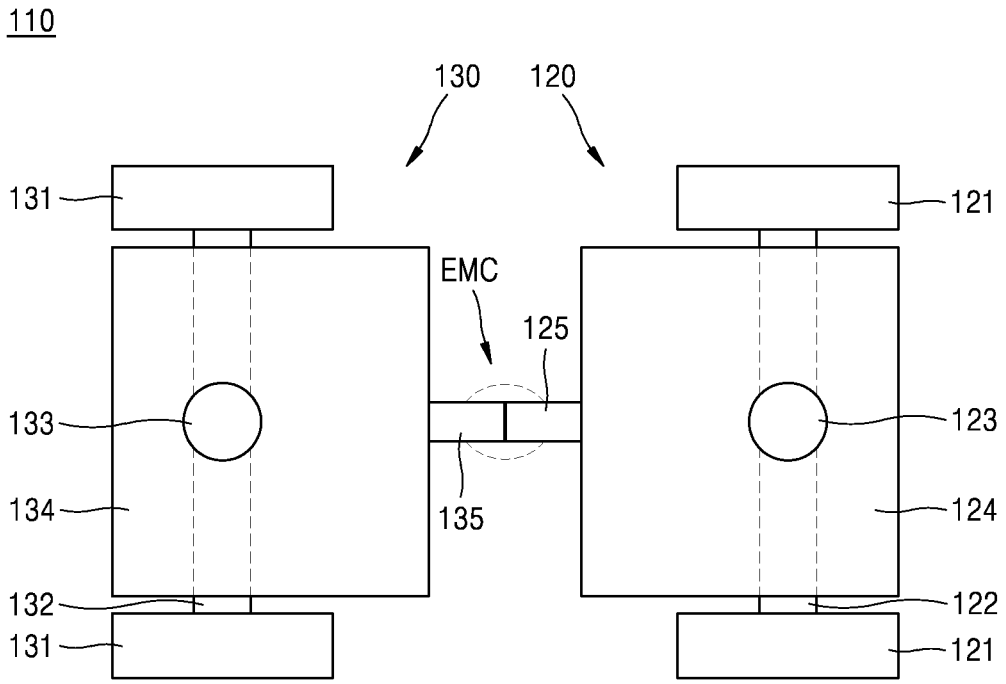
FIGS. 2A and 2B are plan views for respectively describing operations of a front driving device and a rear driving device of FIG. 1.
Figure 2B:
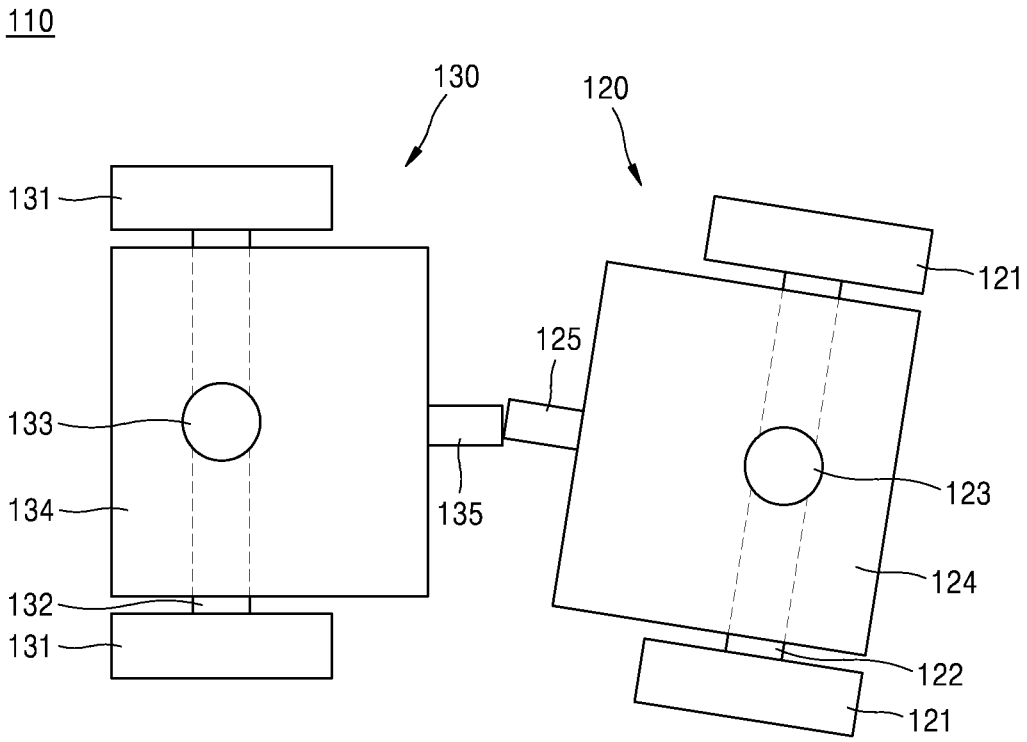

FIGS. 2A and 2B are plan views for describing operations of the front driving device 120 and the rear driving device 130 of FIG. 1.

Referring to FIGS. 1 and 2A, when the transport vehicle 110 drives along the straight section of the driving rail 102, the front vibration reduction device 125 and the rear vibration reduction device 135 may be electromagnetically coupled to each other. That is, an electromagnetic coupling EMC may be formed between the front vibration reduction device 125 and the rear vibration reduction device 135. The electromagnetic coupling EMC may be one of a coupling by a magnetic force and a coupling by an electrostatic force.

As described above, in order for the transport vehicle 110 to move along the corner section of the driving rail 102, the front drive shaft 122 of the front driving device 120 and the rear drive shaft 132 of the rear driving device 130 may be configured to rotate with respect to the front body 124 and the rear body 134 respectively. Accordingly, even when the transport vehicle 110 drives in a straight line, because the front drive shaft 122 and the rear drive shaft 132 may not be fixed to the front body 124 and the rear body 134 respectively, a vibration may occur in the transport vehicle 110 and the material 10. The vibration of the transport vehicle 110 and the material 10 may cause instability in the driving of the transport vehicle 110 and damage to the material 10.

As a non-limiting example, one of the front vibration reduction device 125 and the rear vibration reduction device 135 may include an electromagnet. For example, the front vibration reduction device 125 may include an electromagnet and the rear vibration reduction device 135 may include a permanent magnet. As another example, the front vibration reduction device 125 may include a permanent magnet and the rear vibration reduction device 135 may include an electromagnet. As another example, the front vibration reduction device 125 and the rear vibration reduction device 135 may include an electromagnet. As another example, the front vibration reduction device 125 may include an electromagnet and the rear vibration reduction device 135 may include a ferromagnetic material. As another example, the front vibration reduction device 125 may include a ferromagnetic material and the rear vibration reduction device 135 may include an electromagnet.

According to embodiments, when the transport vehicle 110 moves in the straight section of the driving rail 102, one of the front vibration reduction device 125 and the rear vibration reduction device 135 may generate an electromagnetic coupled EMC. For example, power for forming a magnetic field may be provided to one of the front vibration reduction device 125 and the rear vibration reduction device 135, which is an electromagnet.

According to embodiments, the vibration generated in the transport vehicle 110 and the material 10 may be reduced by the electromagnetic coupling EMC between the front vibration reduction device 125 and the rear vibration reduction device 135. According to an experimental example, by the electromagnetic coupling EMC between the front vibration reduction device 125 and the rear vibration reduction device 135, the vibration transmitted to the front driving device 120, the rear driving device 130, and the material 10 was reduced by about 20% or more.

The controller may recognize the position of the transport vehicle 110 on the driving rail 102. The controller may control the formation of an electromagnetic coupling EMC between the front vibration reduction device 125 and the rear vibration reduction device 135 based on the position on the driving rail 102 of the transport vehicle 110. The controller of the transport vehicle 110 may control at least one of the front vibration reduction device 125 and the rear vibration reduction device 135 such that an electromagnetic couple EMC may be formed between the front vibration reduction device 125 and the rear vibration reduction device 135 while the transport vehicle 110 moves in the straight section of the driving rail 102.

The controller may be implemented as hardware, firmware, software, or any combination thereof. For example, the controller may include a computing device such as a workstation computer, a desktop computer, a laptop computer, and/or a tablet computer. The controller may include a simple controller, a complex processor such as a microprocessor, a central processing unit (CPU), or a graphic processing unit (GPU), a processor including software, and/or dedicated hardware or firmware. The controller may be implemented by, for example, a general-purpose computer or application-specific hardware such as a digital signal processor (DSP), a field programmable gate array (FPGA), and an application-specific Integrated Circuit (ASIC).

Firmware, software, routines, and/or instructions may also be configured to perform the operation described above with respect to the controller or any operation described below. For example, the controller may be configured to generate a signal for providing power for forming a magnetic field to one of the front vibration reduction device 125 and the rear vibration reduction device 135 such that an electromagnetic coupling EMC may be formed between the front vibration reduction device 125 and the rear vibration reduction device 135.

Referring to FIGS. 1 and 2B, when the transport vehicle 110 drives along the corner section of the driving rail 102, an electromagnetic coupling EMC (see FIG. 2A) may not be formed between the front vibration reduction device 125 and the rear vibration reduction device 135. For example, power for forming a magnetic field in one of the front vibration reduction device 125 and the rear vibration reduction device 135, which is an electromagnet, may be interrupted.

Accordingly, the front drive shaft 122 and the rear drive shaft 132 may freely rotate with respect to the front body 124 and the rear body 134 respectively, and the transport vehicle 110 may move along the corner section of the driving rail 102.

The controller of the transport vehicle 110 may control at least one of the front vibration reduction device 125 and the rear vibration reduction device 135 such that an electromagnetic couple EMC may not be formed between the front vibration reduction device 125 and the rear vibration reduction device 135 while the transport vehicle 110 moves in the corner section of the driving rail 102. For example, the controller may be configured to generate a signal for interrupting power for forming a magnetic field to one of the front vibration reduction device 125 and the rear vibration reduction device 135 such that an electromagnetic coupling EMC may not be formed between the front vibration reduction device 125 and the rear vibration reduction device 135.

Figure 3A:
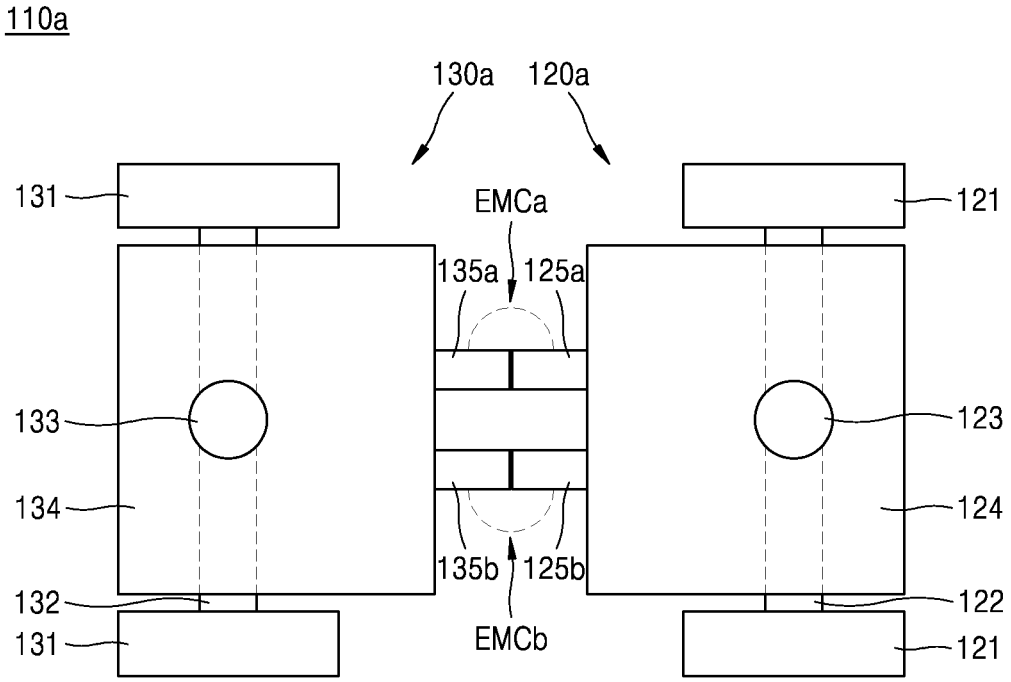
FIGS. 3A to 3C are plan views for describing a transport vehicle according to other embodiments.
Figure 3B:
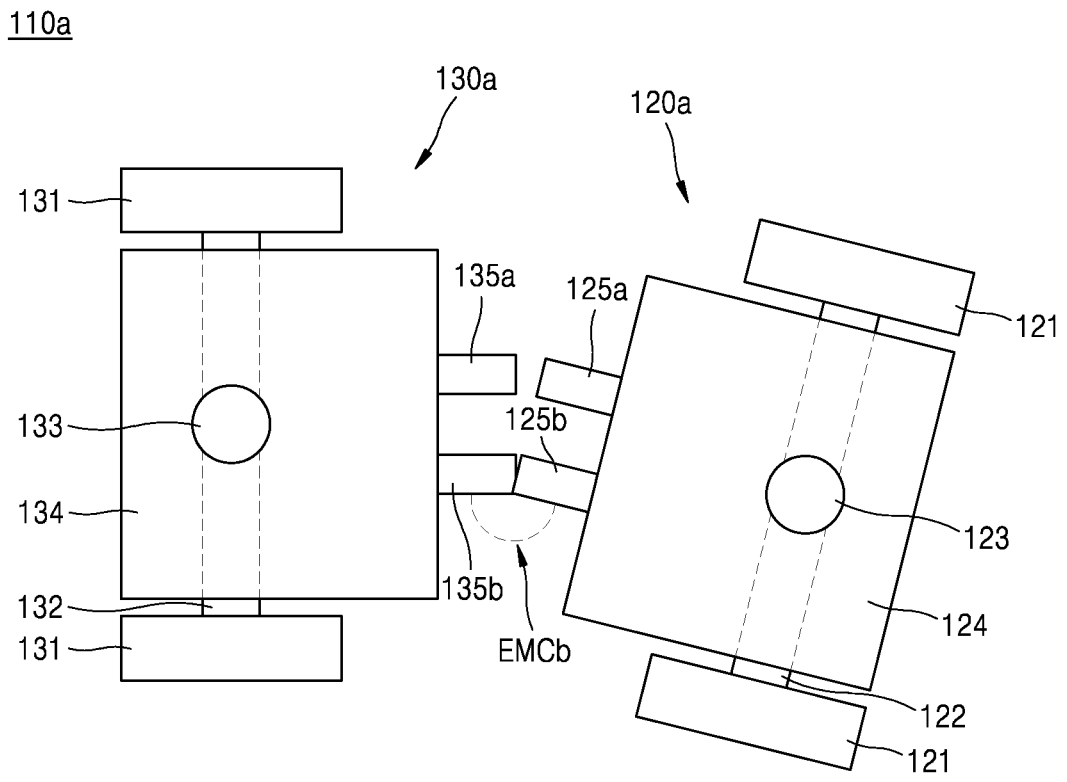
Figure 3C:
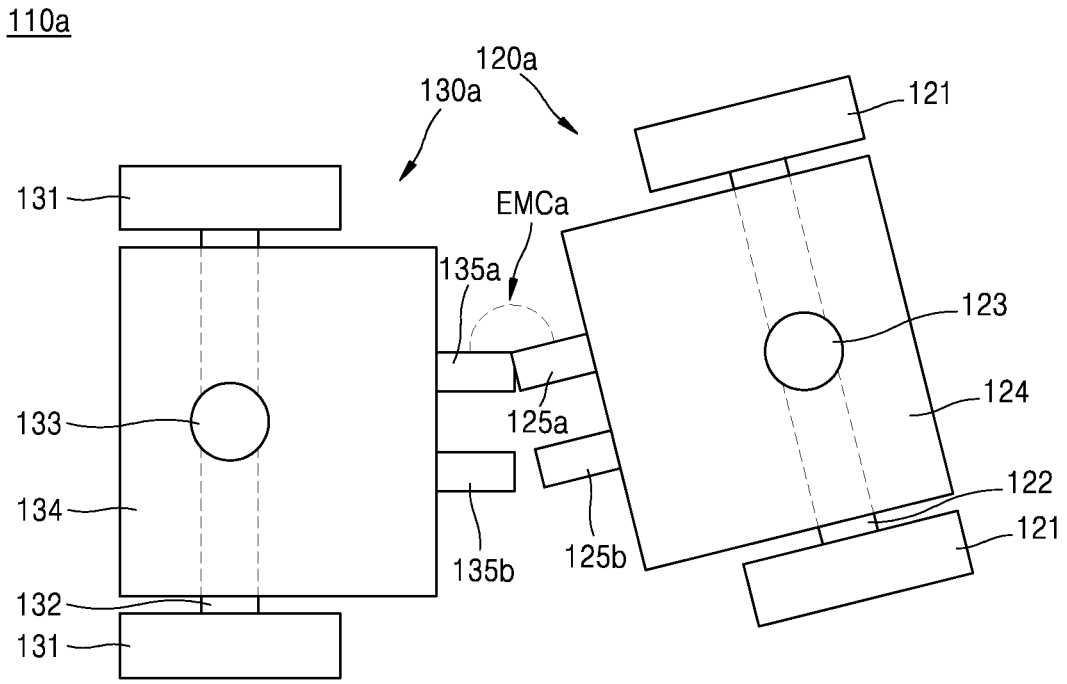

FIGS. 3A to 3C are plan views for describing a transport vehicle 110*a* according to other embodiments.

Referring to FIG. 3A, the transport vehicle 110*a* may include a front driving device 120*a* and a rear driving device 130*a*. The front driving device 120*a* and the rear driving device 130*a* may be arranged on the driving rail 102 (see FIG. 1).

The front driving device 120*a* may include front wheels 121, a front drive shaft 122, a front rotation shaft 123, a front body 124, a first front vibration reduction device 125*a*, and a second front vibration reduction device 125*b*.

The rear driving device 130*a* may include rear wheels 131, a rear drive shaft 132, a rear rotation shaft 133, a rear body 134, a first rear vibration reduction device 135*a*, and a second rear vibration reduction device 135*b*.

Because the front drive shaft 122, the front rotation shaft 123, the front body 124, the rear wheels 131, the rear drive shaft 132, the rear rotation shaft 133, and the rear body 134 are substantially the same as those described above with reference to FIGS. 1 to 2B, redundant descriptions thereof will be omitted for conciseness.

One of the first front vibration reduction device 125*a* and the first rear vibration reduction device 135*a* may include an electromagnet. For example, the first front vibration reduction device 125*a* may include an electromagnet and the first rear vibration reduction device 135*a* may include a permanent magnet. As another example, the first front vibration reduction device 125*a* may include a permanent magnet and the first rear vibration reduction device 135*a* may include an electromagnet. As another example, the first front vibration reduction device 125*a* and the first rear vibration reduction device 135*a* may include an electromagnet. As another example, the first front vibration reduction device 125*a* may include an electromagnet and the first rear vibration reduction device 135*a* may include a ferromagnetic material. As another example, the first front vibration reduction device

125*a* may include a ferromagnetic material and the first rear vibration reduction device 135*a* may include an electromagnet.

One of the second front vibration reduction device 125*b* and the second rear vibration reduction device 135*b* may include an electromagnet. For example, the second front vibration reduction device 125*b* may include an electromagnet and the second rear vibration reduction device 135*b* may include a permanent magnet. As another example, the second front vibration reduction device 125*b* may include a permanent magnet and the second rear vibration reduction device 135*b* may include an electromagnet. As another example, the second front vibration reduction device 125*b* and the second rear vibration reduction device 135*b* may include an electromagnet. As another example, the second front vibration reduction device 125*b* may include an electromagnet and the second rear vibration reduction device 135*b* may include a ferromagnetic material. As another example, the second front vibration reduction device 125*b* may include a ferromagnetic material and the second rear vibration reduction device 135*b* may include an electromagnet.

According to embodiments, when the transport vehicle 110 moves in the straight section of the driving rail 102 (see FIG. 1), an electromagnetic coupling EMCa may be generated between the first front vibration reduction device 125*a* and the first rear vibration reduction device 135*a* and an electromagnetic coupling EMCb may be generated between the second front vibration reduction device 125*b* and the second rear vibration reduction device 135*b*. For example, power for forming a magnetic field may be provided to one of the first front vibration reduction device 125*a* and the first rear vibration reduction device 135*a*, which is an electromagnet, and power for forming a magnetic field may be provided to one of the second front vibration reduction device 125*b* and the second rear vibration reduction devices 135*b*, which is an electromagnet.

According to embodiments, the vibration generated in the transport vehicle 110*a* and the material 10 may be reduced by the electromagnetic coupling EMCa between the first front vibration reduction device 125*a* and the first rear vibration reduction device 135*a* and the electromagnetic coupling EMCb between the second front vibration reduction device 125*b* and the second rear vibration reduction device 135*b*.

Referring to FIGS. 3B and 3C, when the transport vehicle 110 drives along the corner section of the driving rail 102 (see FIG. 1), only one of an electromagnetic coupling EMCa between the first front vibration reduction device 125*a* and the first rear vibration reduction device 135*a* and an electromagnetic coupling EMCb between the second front vibration reduction device 125*b* and the second rear vibration reduction device 135*b* may be formed.

When the transport vehicle 110 drives along the corner section of the driving rail 102 (see FIG. 1), only one of the electromagnetic coupling EMCa between the first front vibration reduction device 125*a* and the first rear vibration reduction device 135*a* and the electromagnetic coupling EMCb between the second front vibration reduction device 125*b* and the second rear vibration reduction device 135*b*, which is in the bent direction of the corner section of the driving rail 102 (see FIG. 1), may be formed.

Hereinafter, the direction from the rear driving device 130*a* to the front driving device 120*a* will be defined as a driving direction. As illustrated in FIG. 3B, when the corner section of the driving rail 102 (see FIG. 1) is bent to the right side with respect to the driving direction, an electromagnetic coupling EMCa may not be formed between the first front vibration reduction device 125*a* and the first rear vibration reduction device 135*a* and an electromagnetic coupling EMCb may be formed between the second front vibration reduction device 125*b* and the second rear vibration reduction device 135*b*.

As illustrated in FIG. 3C, when the corner section of the driving rail 102 (see FIG. 1) is bent to the left side with respect to the driving direction, an electromagnetic coupling EMCa may be formed between the first front vibration reduction device 125*a* and the first rear vibration reduction device 135*a* and an electromagnetic coupling EMCb may not be formed between the second front vibration reduction device 125*b* and the second rear vibration reduction device 135*b*.

As illustrated in FIG. 3A, when the transport vehicle 110 moves in the straight section of the driving rail 102 (see FIG. 1), the controller of the transport vehicle 110 may be configured to generate a signal for supplying power for forming a magnetic field in at least one of the first front vibration reduction device 125*a* and the first rear vibration reduction device 135*a* and at least one of the second front vibration reduction device 125*b* and the second rear vibration reduction device 135*b* such that the electromagnetic couplings EMCa and EMCb may be formed between the first and second front vibration reduction devices 125*a* and 125*b* and the first and second rear vibration reduction devices 135*a* and 135*b*.

As illustrated in FIG. 3B, when the transport vehicle 110 moves in the corner section of the driving rail 102 (see FIG. 1) bent to the right side, the controller of the transport vehicle 110 may be configured to generate a signal for interrupting power for forming a magnetic field in at least one of the first front vibration reduction device 125*a* and the first rear vibration reduction device 135*a* and supplying power for forming a magnetic field in at least one of the second front vibration reduction device 125*b* and the second rear vibration reduction device 135*b* such that an electromagnetic coupling EMCa may not be formed between the first front vibration reduction device 125*a* and the first rear vibration reduction device 135*a* and an electromagnetic coupling EMCb may be formed between the second front vibration reduction device 125*b* and the second rear vibration reduction device 135*b*.

As illustrated in FIG. 3C, when the transport vehicle 110 moves in the corner section of the driving rail 102 (see FIG. 1) bent to the left side, the controller of the transport vehicle 110 may be configured to generate a signal for supplying power for forming a magnetic field in at least one of the first front vibration reduction device 125*a* and the first rear vibration reduction device 135*a* and interrupting power for forming a magnetic field in at least one of the second front vibration reduction device 125*b* and the second rear vibration reduction device 135*b* such that an electromagnetic coupling EMCa may be formed between the first front vibration reduction device 125*a* and the first rear vibration reduction device 135*a* and an electromagnetic coupling EMCb may not be formed between the second front vibration reduction device 125*b* and the second rear vibration reduction device 135*b*.

Figure 4A:
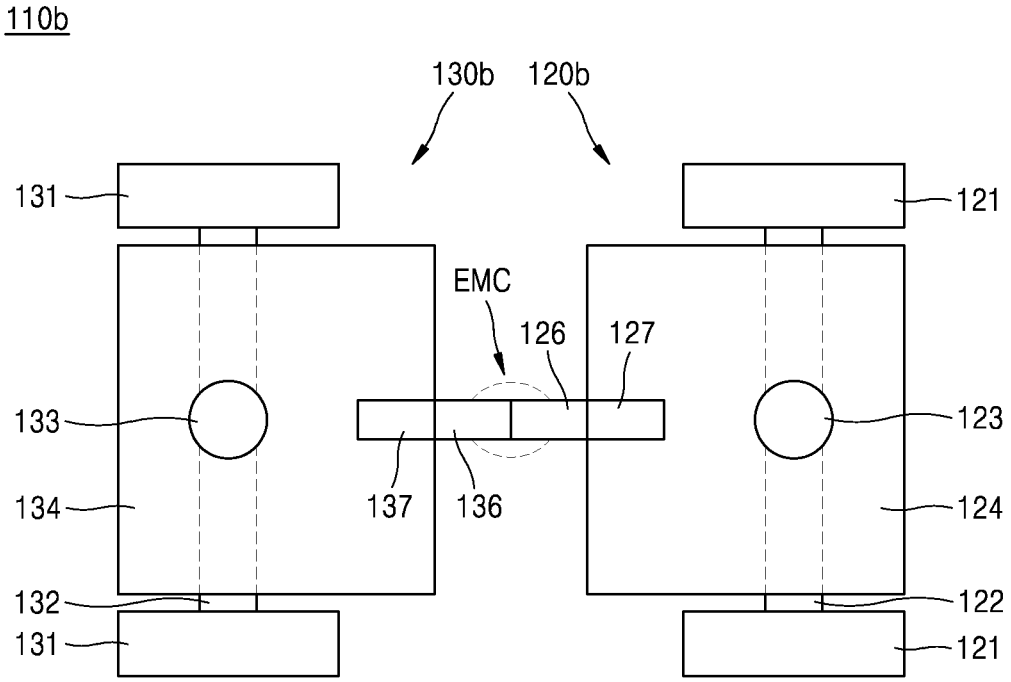
FIGS. 4A and 4B are plan views for describing a transport vehicle according to other embodiments.
Figure 4B:
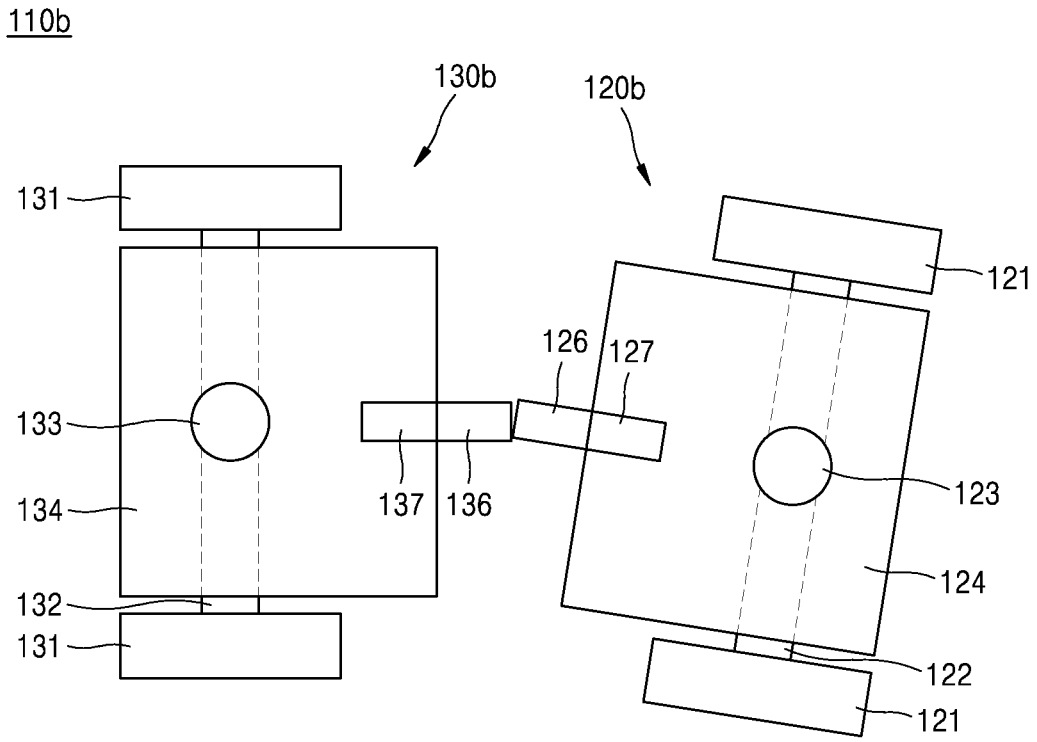

FIGS. 4A and 4B are plan views for describing a transport vehicle 110*b* according to other embodiments.

Referring to FIG. 4A, the transport vehicle 110*b* may include a front driving device 120*b* and a rear driving device 130*b*. The front driving device 120*b* and the rear driving device 130*b* may be arranged on the driving rail 102 (see FIG. 1).

The front driving device 120*b* may include front wheels 121, a front drive shaft 122, a front rotation shaft 123, a front body 124, a front vibration reduction device 126, and a front disconnection device 127.

The rear driving device 130*b* may include rear wheels 131, a rear drive shaft 132, a rear rotation shaft 133, a rear body 134, a rear vibration reduction device 136, and a rear disconnection device 137.

Because the front drive shaft 122, the front rotation shaft 123, the front body 124, the rear wheels 131, the rear drive shaft 132, the rear rotation shaft 133, and the rear body 134 are substantially the same as those described above with reference to FIGS. 1 to 2B, redundant descriptions thereof will be omitted for conciseness.

Each of the front vibration reduction device 126 and the rear vibration reduction device 136 may include a permanent magnet. Accordingly, the vibration generated in the transport vehicle 110*b* while the transport vehicle 110*b* moves in the straight section of the driving rail 102 (see FIG. 1) may be alleviated. Furthermore, according to embodiments, because the transport vehicle 110*b* may maintain the electromagnetic coupling EMC without external power supply while driving in the straight section of the driving rail 102 (see FIG. 1), the energy efficiency of the transport vehicle 110*b* may be improved.

Referring to FIG. 4B, when the transport vehicle 110*b* drives along the corner section of the driving rail 102 (see FIG. 1), an electromagnetic coupling EMC (see FIG. 4A) may not be formed between the front vibration reduction device 126 and the rear vibration reduction device 136.

The front disconnection device 127 and the rear disconnection device 137 may include an electromagnet. When the transport vehicle 110*b* drives along the corner section of the driving rail 102 (see FIG. 1), the front disconnection device 127 may be configured to generate a magnetic field for cancelling the magnetic field of the front vibration reduction device 126 and the rear disconnection device 137 may be configured to generate a magnetic field for cancelling the magnetic field of the rear vibration reduction device 136.

Accordingly, the front drive shaft 122 and the rear drive shaft 132 may freely rotate with respect to the front body 124 and the rear body 134 respectively, and the transport vehicle 110*b* may move along the corner section of the driving rail 102.

The controller of the transport vehicle 110*b* may control at least one of the front disconnection device 127 and the rear disconnection device 137 such that an electromagnetic couple EMC (see FIG. 4A) may not be formed between the front vibration reduction device 126 and the rear vibration reduction device 136 while the transport vehicle 110 moves in the corner section of the driving rail 102. For example, the controller may be configured to generate a signal for supplying power for forming a magnetic field in each of the front disconnection device 127 and the rear disconnection device 137 in order to cancel the magnetic field of the front vibration reduction device 126 and the rear vibration reduction device 136.

Figure 5A:
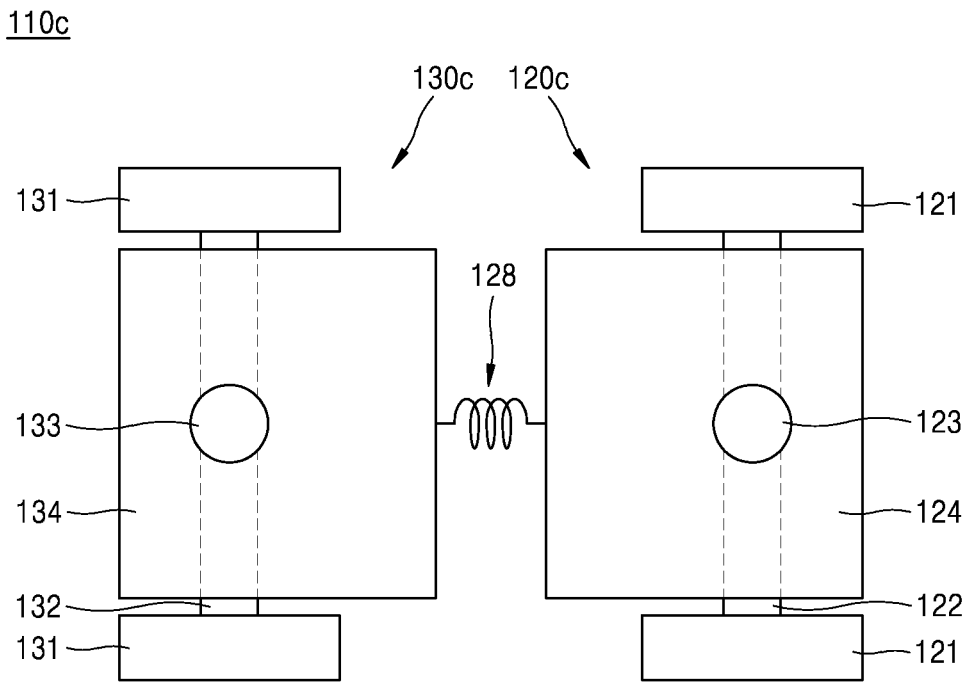
FIGS. 5A and 5B are plan views for describing a transport vehicle according to other embodiments.
Figure 5B:
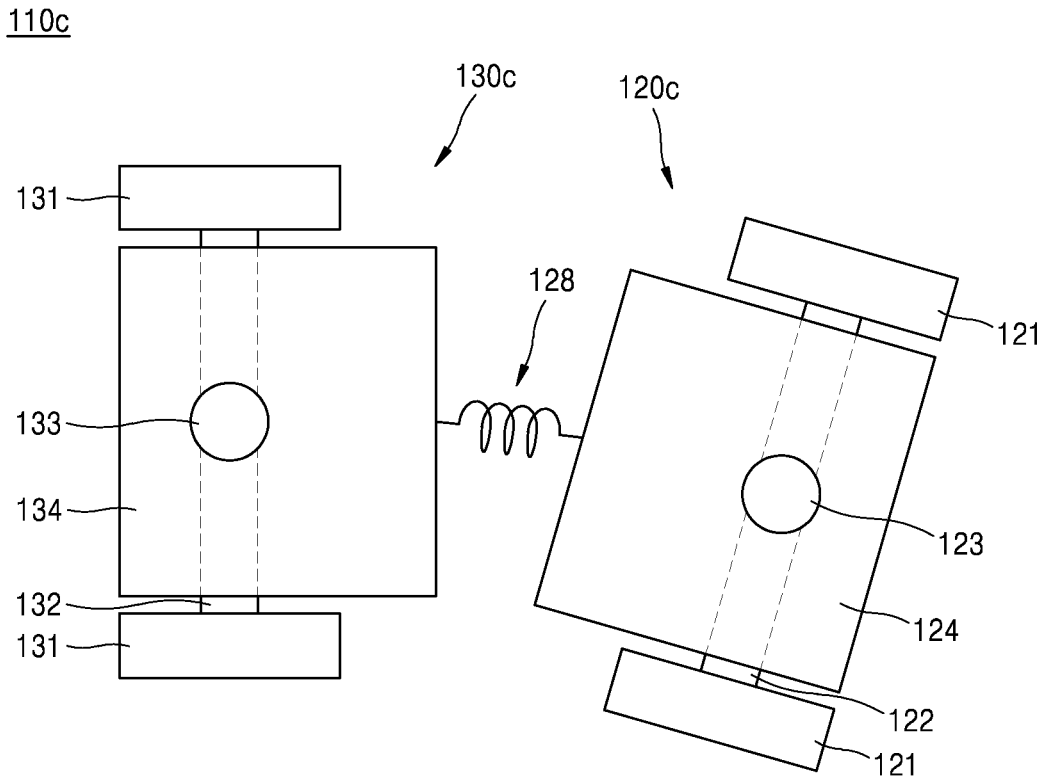

FIGS. 5A and 5B are plan views for describing a transport vehicle 110*c* according to other embodiments.

Referring to FIG. 5A, the transport vehicle 110*c* may include a front driving device 120*c*, a rear driving device 130*c*, and a vibration reduction device 128.

The front driving device 120*c* and the rear driving device 130*c* may be arranged on the driving rail 102 (see FIG. 1).

The front driving device 12*c* may include front wheels 121, a front drive shaft 122, a front rotation shaft 123, and a front body 124.

The rear driving device 130*c* may include rear wheels 131, a rear drive shaft 132, a rear rotation shaft 133, and a rear body 134.

Because the front drive shaft 122, the front rotation shaft 123, the front body 124, the rear wheels 131, the rear drive shaft 132, the rear rotation shaft 133, and the rear body 134 are substantially the same as those described above with reference to FIGS. 1 to 2B, redundant descriptions thereof will be omitted for conciseness.

The vibration reduction device 128 may be connected to each of the front driving device 120*c* and the rear driving device 130*c*. The vibration reduction device 128 may provide a physical (or mechanical) coupling to the front driving device 120*c* and the rear driving device 130*c*.

According to embodiments, the vibration reduction device 128 may include an elastic element and a damping element connected in series or in parallel. According to embodiments, the vibration reduction device 128 may include a coil spring.

According to embodiments, the vibration reduction device 128 may have a variable length. As illustrated in FIG. 5A, a first length, which is the length of the vibration reduction device 128 when the transport vehicle 110*c* is located in the straight section of the driving rail 102 (see FIG. 1), may be different from a second length, which is the length of the vibration reduction device 128 when the transport vehicle 110*c* is located in the corner section of the driving rail 102 (see FIG. 1). As illustrated in FIG. 5A, the second length may be greater than the first length.

According to embodiments, because the front driving device 120*c* and the rear driving device 130*c* are coupled to each other by the vibration reduction device 128, the vibration generated in the transport vehicle 110*c* while the transport vehicle 110*c* moves in the straight section of the driving rail 102 (see FIG. 1) may be alleviated.

Also, as illustrated in 5B, when the transport vehicle 110*c* drives along the corner section of the driving rail 102 (see FIG. 1), because the length of the vibration reduction device 128 increases, the front drive shaft 122 and the rear drive shaft 132 may freely rotate with respect to the front body 124 and the rear body 134 respectively and the transport vehicle 110*c* may move along the corner section of the driving rail 102.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A transport apparatus comprising:

a hoist device configured to grip a material; and a transport vehicle coupled to the hoist device and configured to transport the hoist device, wherein the transport vehicle comprises:

a front driving device comprising front wheels, a front drive shaft transmitting a driving force to the front wheels, and a front vibration reduction device; and a rear driving device comprising rear wheels, a rear drive shaft transmitting a driving force to the rear wheels, and a rear vibration reduction device, wherein, when the transport vehicle moves in a straight section, the front vibration reduction device and the rear vibration reduction device are coupled to each other, and when the transport vehicle moves in a corner section, the front vibration reduction device and the rear vibration reduction device are separated from each other.

2. The transport apparatus of claim 1, wherein the front vibration reduction device and the rear vibration reduction device are electromagnetically coupled to each other.

3. The transport apparatus of claim 1, wherein the front vibration reduction device is located on a horizontal center line of the front driving device, and the rear vibration reduction device is located on a horizontal center line of the rear driving device.

4. The transport apparatus of claim 1, wherein the front vibration reduction device and the rear vibration reduction device vertically overlap each other.

5. The transport apparatus of claim 1, wherein at least one of the front vibration reduction device and the rear vibration reduction device comprises an electromagnet.

6. The transport apparatus of claim 5, wherein the transport vehicle further comprises a controller configured to control the front vibration reduction device and the rear vibration reduction device based on a position of the transport vehicle.

7. The transport apparatus of claim 6, wherein the controller is further configured to generate a signal for supplying or interrupting power for forming a magnetic field in at least one of the front vibration reduction device and the rear vibration reduction device.

8. The transport apparatus of claim 1, wherein the front vibration reduction device comprises a permanent magnet.

9. The transport apparatus of claim 8, wherein the front driving device further comprises a front disconnection device configured to disconnect an electromagnetic coupling between the front vibration reduction device and the rear vibration reduction device.

10. The transport apparatus of claim 9, wherein the front disconnection device comprises an electromagnet.

11. The transport apparatus of claim 9, wherein the front disconnection device is configured to cancel a magnetic field generated by the front vibration reduction device.

12. The transport apparatus of claim 9, wherein the transport vehicle further comprises a controller configured to generate, based on a position of the transport vehicle, a signal for supplying or interrupting power for cancelling the magnetic field of the front vibration reduction device to the front disconnection device.

13. A transport vehicle configured to transport a hoist device, the transport vehicle comprising:

a front driving device comprising front wheels, a front drive shaft transmitting a driving force to the front wheels, a first front vibration reduction device, and a second front vibration reduction device; and a rear driving device comprising rear wheels, a rear drive shaft transmitting a driving force to the rear wheels, a first rear vibration reduction device, and a second rear vibration reduction device, wherein, when the transport vehicle moves in a straight section, the first front vibration reduction device and the first rear vibration reduction device are electromagnetically coupled to each other and the second front vibration reduction device and the second rear vibration reduction device are electromagnetically coupled to each other.

14. The transport vehicle of claim 13, wherein, when the transport vehicle moves in a corner section, only one of an electromagnetic coupling between the first front vibration reduction device and the first rear vibration reduction device and an electromagnetic coupling between the second front vibration reduction device and the second rear vibration reduction device is formed.

15. The transport vehicle of claim 14, wherein, when the corner section is bent to a right side with respect to a driving direction of the transport vehicle, an electromagnetic coupling is formed between the second front vibration reduction device and the second rear vibration reduction device.

16. The transport vehicle of claim 14, wherein, when the corner section is bent to a left side with respect to a driving direction of the transport vehicle, an electromagnetic coupling is formed between the first front vibration reduction device and the first rear vibration reduction device.

17. A transport apparatus comprising:

a hoist device configured to grip a material; and a transport vehicle coupled to the hoist device and configured to transport the hoist device, wherein the transport vehicle comprises:

a front driving device comprising a front body connected to the hoist device, a front rotation shaft configured to rotate with respect to the front body, a front drive shaft connected to the front rotation shaft, and front wheels connected to the front drive shaft;

a rear driving device comprising a rear body connected to the hoist device, a rear rotation shaft configured to rotate with respect to the rear body, a rear drive shaft connected to the rear rotation shaft, and rear wheels connected to the rear drive shaft; and a vibration reduction device connected to each of the front driving device and the rear driving device.

18. The transport apparatus of claim 17, wherein a length of the vibration reduction device is variable.

19. The transport apparatus of claim 17, wherein a length of the vibration reduction device when the transport vehicle is located in a corner section is greater than a length of the vibration reduction device when the transport vehicle is located in a straight section.

20. The transport apparatus of claim 17, wherein the vibration reduction device comprises a coil spring.

* * * * *